US010167536B2

(12) United States Patent
Yamamoto et al.

(10) Patent No.: US 10,167,536 B2
(45) Date of Patent: Jan. 1, 2019

(54) TUNGSTEN ALLOY, TUNGSTEN ALLOY PART, DISCHARGE LAMP, TRANSMITTING TUBE, AND MAGNETRON

(71) Applicants: KABUSHIKI KAISHA TOSHIBA, Tokyo (JP); TOSHIBA MATERIALS CO., LTD., Yokohama-Shi (JP)

(72) Inventors: Shinichi Yamamoto, Fujisawa (JP); Kayo Nakano, Yokohama (JP); Hiromichi Horie, Yokosuka (JP); Takashi Sano, Fujisawa (JP); Yoshiko Minami, Machida (JP); Satoshi Yamaguchi, Hachioji (JP)

(73) Assignees: Kabushiki Kaisha Toshiba, Minato-ku (JP); Toshiba Materials Co., Ltd., Yokohama-shi (JP)

( * ) Notice: Subject to any disclaimer, the term of this patent is extended or adjusted under 35 U.S.C. 154(b) by 0 days.

(21) Appl. No.: 15/784,416

(22) Filed: Oct. 16, 2017

(65) Prior Publication Data

US 2018/0073107 A1 Mar. 15, 2018

Related U.S. Application Data

(63) Continuation of application No. 14/309,025, filed on Jun. 19, 2014, now Pat. No. 9,834,830, which is a (Continued)

(30) Foreign Application Priority Data

Dec. 20, 2011 (JP) ..... 2011-278944
Jul. 3, 2012 (JP) ..... 2012-150017

(51) Int. Cl.
*C22C 27/04* (2006.01)
*B22F 3/10* (2006.01)
(Continued)

(52) U.S. Cl.
CPC ..... *C22C 27/04* (2013.01); *B22F 3/1007* (2013.01); *C22C 1/045* (2013.01); *C22C 43/00* (2013.01); *C22F 1/18* (2013.01); *H01J 23/05* (2013.01)

(58) Field of Classification Search
CPC ..... B22F 3/1007; H01J 23/05; C22F 1/18
See application file for complete search history.

(56) References Cited

U.S. PATENT DOCUMENTS 3,395,013 A 7/1968 Friedman
3,676,084 A 7/1972 Quatinetz et al.
(Continued)

FOREIGN PATENT DOCUMENTS

CN 1445377 A 10/2003
CN 101167156 A 4/2008
(Continued)

OTHER PUBLICATIONS

International Search Report and Written Opinion (Application No. PCT/JP2012/083106) dated Mar. 12, 2013.
(Continued)

*Primary Examiner* — Jessee R Roe
(74) *Attorney, Agent, or Firm* — Burr & Brown, PLLC

(57) ABSTRACT

According to one embodiment, a tungsten alloy includes a W component and a Hf component including HfC. A content of the Hf component in terms of HfC is 0.1 wt % or more and 3 wt % or less.

8 Claims, 4 Drawing Sheets

Related U.S. Application Data continuation of application No. PCT/JP2012/083106, filed on Dec. 20, 2012.

(51) Int. Cl.

| | |
|---|---|
| ***C22C 1/04*** | (2006.01) |
| ***C22C 43/00*** | (2006.01) |
| ***H01J 23/05*** | (2006.01) |
| ***C22F 1/18*** | (2006.01) |

(56) References Cited

U.S. PATENT DOCUMENTS

| | | | | |
|---|---|---|---|---|
| 4,002,940 | A * | 1/1977 | Ekkelboom | H01J 61/0732 313/346 R |
| 4,448,606 | A * | 5/1984 | Rhodes | C22C 32/0052 419/17 |
| 4,577,134 | A | 3/1986 | Clerc | |
| 4,612,162 | A * | 9/1986 | Morgan | B22F 3/15 419/23 |
| 4,864,191 | A | 9/1989 | Van De Weijer et al. | |
| 2005/0104521 | A1 | 5/2005 | Berndanner et al. | |
| 2005/0129565 | A1 | 6/2005 | Ohriner et al. | |
| 2006/0266158 | A1 | 11/2006 | Shindo | |
| 2007/0172378 | A1 | 7/2007 | Shibuya et al. | |
| 2009/0128039 | A1 | 5/2009 | Wang et al. | |
| 2010/0194415 | A1 * | 8/2010 | Wajata | C22C 32/0047 324/755.01 |
| 2011/0243184 | A1 | 10/2011 | Nakabayashi et al. | |
| 2011/0305324 | A1 * | 12/2011 | Lee | H01J 35/10 378/121 |
| 2013/0126588 | A1 * | 5/2013 | Grant | B23K 20/1245 228/2.1 |

FOREIGN PATENT DOCUMENTS

| | | | |
|---|---|---|---|
| CN | 102246260 | A | 11/2011 |
| JP | 08-260070 | A1 | 10/1996 |
| JP | 2002-226935 | A1 | 8/2002 |
| JP | WO2005/073418 | A1 | 8/2005 |
| JP | 2006-102775 | A1 | 4/2006 |
| JP | 2007-113104 | A1 | 5/2007 |
| JP | 2008-073712 | A1 | 4/2008 |
| JP | 2008-115063 | A1 | 5/2008 |
| JP | 2008-179897 | A1 | 8/2008 |
| JP | 2008-539332 | A1 | 11/2008 |
| JP | 2009-102670 | A1 | 5/2009 |
| JP | 2010-196172 | A1 | 9/2010 |
| JP | 2011-103240 | A1 | 5/2011 |
| JP | 4741190 | B2 | 8/2011 |

OTHER PUBLICATIONS

Hishashi Suzuki, "*Carbide Relational Phase Diagram*," Journal of the Patent Institute of Metals and Materials, Japan, The Japan Institute of Metals and Materials, Jan. 1996, vol. 5, 1st Issue, pp. 9-16.

Japanese Office Action (Application No. 2013-550337) dated Mar. 24, 2015.

Chinese Office Action (Application No. 201280062477.1) dated Jul. 21, 2015 (with English translation).

Extended European Search Report (Application No. 12 860 308.1) dated Sep. 11, 2015.

Chinese Office Action (Application No. 201280062477.1) dated Mar. 29, 2016 (with English translation).

Park, J.J. et al., "Formation of Subgrains in Tungsten-Rhenium-Hafnium Carbide Alloys During Creep," *Journal of Materials Science Letters,* vol. 18, 1999, pp. 273-275.

Klopp et al., "Mechanical Properties of a Tungsten-23.4 Percent Rhenium-0.27 Percent Hafnium-Carbon Alloy," *Journal of the Less-Common Metals,* 24, 1971, 427-443.

* cited by examiner

TUNGSTEN ALLOY, TUNGSTEN ALLOY PART, DISCHARGE LAMP, TRANSMITTING TUBE, AND MAGNETRON

CROSS REFERENCE TO RELATED APPLICATIONS

This application is a continuation of U.S. application Ser. No. 14/309,025, filed Jun. 19, 2014, now U.S. Pat. No. 9,834,830, which is a continuation of International Application No. PCT/JP2012/083106, filed Dec. 20, 2012, and claims the benefit of Japanese Patent Application No. 2011-278944, filed Dec. 20, 2011, and Japanese Patent Application No. 2012, the entireties of which are incorporated herein by reference.

FIELD OF THE INVENTION

Embodiments described herein relate to generally to a tungsten alloy, and a tungsten alloy part, a discharge lamp electrode part, a discharge lamp, a, transmitting tube, and a magnetron which use the same.

BACKGROUND OF THE INVENTION

A tungsten alloy part is used in various fields utilizing the strength of tungsten at high temperature. Examples thereof include a discharge lamp, a transmitting tube, and a magnetron. The tungsten alloy part is used for a cathode electrode, an electrode supporting rod, and a coil part or the like in the discharge lamp (HID lamp). The tungsten alloy part is used for a filament and a mesh grid or the like in the transmitting tube. The tungsten alloy part is used for the coil part or the like in the magnetron. These tungsten alloy parts include a sintered body having a predetermined shape, a wire rod, and a coil part obtained by processing the wire rod into a coil form.

Conventionally, as described in Jpn. Pat. Appln. KOKAI Publication No. 2002-226935 (Patent Literature 1), a tungsten alloy containing thorium or a thorium compound is used for these tungsten alloy parts. In the tungsten alloy of Patent Literature 1, deformation resistance is improved by finely dispersing thorium particles and thorium compound particles so that the average particle diameter thereof is set to 0.3 μm or less. Since the thorium-containing tungsten alloy has excellent emitter characteristics and mechanical strength at a high temperature, the thorium-containing tungsten alloy is used in the above fields.

However, since thorium or the thorium compound is a radioactive material, a tungsten alloy part using no thorium is desired in consideration of the influence on the environment. In Jpn. Pat. Appln. KOKAI Publication No. 2011-103240 (Patent Literature 2), a tungsten alloy part containing boride lanthanum ($LaB_6$) has been developed as the tungsten alloy part using no thorium.

On the other hand, a short arc type high-pressure discharge lamp using a tungsten alloy containing lanthanum trioxide ($La_2O_3$) and $HfO_2$ or $ZrO_2$ is described in Patent Literature 3. According to the tungsten alloy described in Patent Literature 3, sufficient emission characteristics are not obtained. This is because lanthanum trioxide has a low melting point of about 2300° C., and lanthanum trioxide is evaporated in an early stage when a part is subjected to a high temperature by increasing an applied voltage or a current density, which causes deterioration in emission characteristics.

CITATION LIST

Patent Literature

Patent Literature 1: Jpn. Pat. Appln. KOKAI Publication No. 2002-226935

Patent Literature 2: Jpn. Pat. Appln. KOKAI Publication No. 2011-103240

Patent Literature 3: Japanese Patent No. 4741190

DETAILED DESCRIPTION OF THE INVENTION

Figure 1:
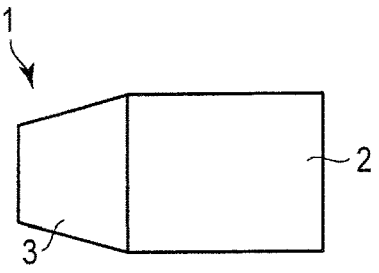
FIG. 1 shows an example of a tungsten alloy part of a first embodiment.

For example, discharge lamps, parts of which use a tungsten alloy, are roughly divided into two kinds (a low-pressure discharge lamp and a high-pressure discharge lamp). Examples of the low-pressure discharge lamp include various arc-discharge type discharge lamps such as for general lighting, special lighting used for a road or a tunnel or the like, a curing apparatus for a coating material, a UV curing apparatus, a sterilizer, and a light cleaning apparatus for a semiconductor or the like. Examples of the high-pressure discharge lamp include a processing apparatus for water supply and sewerage, general lighting, outdoor lighting for a stadium or the like, a UV curing apparatus, an exposure device for a semiconductor and a printed circuit board or the like, a wafer inspection apparatus, a high-pressure mercury lamp such as a projector, a metal halide lamp, an extra high pressure mercury lamp, a xenon lamp, and a sodium lamp.

A voltage of 10 V or more is applied to the discharge lamp according to the application. When a voltage is less than 100 V, a life equal to that of the thorium-containing tungsten alloy is obtained for the tungsten alloy containing boride lanthanum described in Patent Literature 2. However, if the voltage is above 100 V, the emission characteristics are deteriorated. As a result, the life is also largely decreased.

Similarly, there is a problem that sufficient characteristics are not obtained also for the transmitting tube or the magnetron if the applied voltage is increased.

The embodiment was made in consideration of the above problem. It is an object of the embodiment to provide a tungsten alloy containing no thorium which is a radioactive material, which is equal to or higher in characteristics than a thorium-containing tungsten alloy, a tungsten alloy part using the tungsten alloy, a discharge lamp using the tungsten alloy, a transmitting tube using the tungsten alloy, and a magnetron using the tungsten alloy.

According to one embodiment, a tungsten alloy includes a W component and a Hf component containing HfC. The content of the Hf component in terms of HfC is 0.1 wt % or more and 5 wt % or less, and preferably 0.1 wt % or more and 3 wt % or less. The average primary particle diameter of HfC particles is desirably 15 μm or less.

The tungsten alloy part of the embodiment contains 0.1 to 3 wt % of Hf in terms of HfC.

The tungsten alloy part preferably contains at least two or more kinds of Hf, HfC, and C. When the total amount of Hf, HfC, and C is represented by $HfC_x$, where x<1. When the total amount of Hf, HfC, and C is preferably represented by $HfC_x$, where 0<x<1. When the total amount of Hf, HfC, and C is represented by $HfC_x$, where 0.2<x<0.7. When the amount of carbon in a surface part in the tungsten alloy part is defined as C1 (wt %) and the amount of carbon in a central part is defined as C2 (wt %), C1<C2 is preferably set. The tungsten alloy part preferably contains 0.01 wt % or less of at least one kind of K, Si, and Al. When the content of Hf is defined as 100 parts by mass, the content of Zr is preferably 10 parts by mass or less. The average crystal particle diameter of tungsten is preferably 1 to 100 μm.

The tungsten alloy part of the embodiment is preferably used for at least one kind of a discharge lamp part, a transmitting tube part, and a magnetron part.

A discharge lamp of the embodiment includes the tungsten alloy part of the embodiment. A transmitting tube of the embodiment includes the tungsten alloy part of the embodiment. A magnetron of the embodiment includes the tungsten alloy part of the embodiment.

The discharge lamp electrode part of the embodiment is made of a tungsten alloy. The tungsten alloy contains 0.1 to 5 wt % of the Hf component in terms of HfC, and the HfC particles in the Hf component have an average particle diameter of 15 μm or less.

The HfC particles preferably have an average particle diameter of 5 μm or less and a maximum diameter of 15 μm or less. Two kinds (HfC and metal Hf) preferably exist as the Hf component. Metal Hf preferably exists as the Hf component on the surfaces of the HfC particles. Preferably, at least a part of metal Hf of the Hf component is solid-solved in tungsten. When the total content of the Hf component is defined as 100 parts by mass, the ratio of Hf contained in the HfC particles is preferably 25 to 75 mass. The tungsten alloy preferably contains 0.01 wt % or less of a dope material made of at least one kind of K, Si, and Al. The tungsten alloy preferably contains 2 wt % or less of at least one kind of Ti, Zr, V, Nb, Ta, Mo, and rare earth elements. A wire diameter is preferably 0.1 to 30 mm. The tungsten alloy preferably has a Vickers hardness within a range of Hv 330 to 700. The discharge lamp electrode part preferably has a tip part having a tapered tip and a cylindrical body part.

When the crystallized structure of the circumferential section of the body part is observed, the area ratio of tungsten crystals having a crystal particle diameter of 1 to 80 μm per unit area of 300 μm×300 μm is preferably 90% or more. When the crystallized structure of the side section of the body part is observed, the area ratio of tungsten crystals having a crystal particle diameter of 2 to 120 μm per unit area of 300 μm×300 μm is preferably 90% or more.

The discharge lamp of the embodiment uses the discharge lamp electrode part of the embodiment. The applied voltage of the discharge lamp is preferably 100 V or more.

Since a tungsten alloy of an embodiment does not contain a radioactive material such as thorium or thoria, the tungsten alloy does not exert a bad influence on the environment. In addition, the tungsten alloy of the embodiment has characteristics equal to or higher than those of a thorium-containing tungsten alloy. For this reason, a tungsten alloy part using the tungsten alloy, a discharge lamp electrode part using the tungsten alloy, a discharge lamp using the tungsten alloy, a transmitting tube using the tungsten alloy, and a magnetron using the tungsten alloy can be used as environment-friendly products.

First Embodiment

A first embodiment provides a tungsten alloy containing a W component and a Hf component containing HfC. The content of the Hf component in terms of HfC is 0.1 wt % or more and 3 wt % or less. The Hf component contains at least HfC, and may contain a Hf-containing compound other than HfC, and a Hf simple substance or the like. Examples of the Hf-containing compound include $HfO_2$.

The tungsten alloy part of the first embodiment is a part made of a tungsten alloy containing 0.1 to 3 wt % of the Hf component in terms of HfC.

The tungsten alloy part contains 0.1 to 3 wt % of the Hf (hafnium) component in terms of HfC (hafnium carbide), and thereby characteristics such as emission characteristics and a strength can be improved. That is, when the content of the Hf component is less than 0.1 wt % in terms of HfC, the addition effect of the Hf component is insufficient. When the content of the Hf component is more than 3 wt %, the characteristics are deteriorated. The content of the Hf component is preferably 0.5 to 2.5 wt % in terms of HfC.

The HfC component contained in the tungsten alloy preferably contains at least two kinds of Hf, HfC, and C. That is, the tungsten alloy contains the HfC component as a combination of Hf and HfC, a combination of Hf and C (carbon), a combination of HfC and C (carbon), or a combination of Hf, HfC, and C (carbon). When the melting points are compared, the melting points of metal Hf, HfC, and tungsten are respectively 2230° C., 3920° C., and 3400° C. (see Iwanami Shoten "Rikagakujiten (Dictionary of Physics and Chemistry)"). The melting points of metal thorium and thorium oxide ($ThO_2$) are respectively 1750° C. and 3220±50° C. Since hafnium has a melting point higher than that of thorium, the tungsten alloy of the embodiment can have a strength at high-temperature equal to or higher than that of a thorium-containing tungsten alloy.

When the total amount of Hf, HfC, and C (carbon) is converted into $HfC_x$, x<1 is preferably set. x<1 means that all of the HfC component contained in the tungsten alloy does not exist as HfC, and a part thereof exist as metal Hf. Since the work function of metal Hf is 3.9, and equal to the work function (3.4) of metal Th, the emission characteristics can be improved. Since metal hafnium forms a solid solution with tungsten, metal hafnium is a component effective in enhancing strength.

When the total amount of Hf, HfC, and C is converted into HfCx, 0<x<1 is preferably set. x<1 is described above. 0<x means that either HfC or C exists as the HfC component contained in the tungsten alloy. At least one of HfC and C has a deoxidation effect for removing an oxygen impurity contained in the tungsten alloy. Since the electrical resistance value of the tungsten alloy part can be decreased by reducing the oxygen impurity, the tungsten alloy part has improved characteristics as an electrode. When the total amount of Hf, HfC, and C is converted into HfCx, $0.2<x<0.7$ is preferably set. In this range, metal Hf, HfC, or C exists in a good balance, to improve characteristics such as emission characteristics, a strength, electrical resistance, and a life.

The contents of Hf, HfC, and C in the tungsten alloy part are measured by using an ICP analysis method and a combustion-infrared absorption method. In the ICP analysis method, a Hf amount obtained by adding a Hf amount of Hf and a Hf amount of HfC can be measured. Similarly, the amount of carbon obtained by adding the amount of carbon of HfC and one of the amount of carbon which independently exists and the amount of carbon which exists as another carbide can be measured by the combustion-infrared absorption method. In the embodiment, the amount of Hf and the amount of C are measured by the ICP analysis method and the combustion-infrared absorption method, and converted into HfOx.

The tungsten alloy part may contain 0.01 wt % or less of at least one kind of K, Si, and Al. K (potassium), Si (silicon), and Al (aluminum) are so-called dope materials. Recrystallization characteristics can be improved by adding these dope materials. The recrystallization characteristics are improved, and thereby a uniform recrystallized structure is likely to be obtained when a recrystallization heat treatment is performed. Although the lower limit of the content of the dope material is not particularly limited, the lower limit is preferably 0.001 wt % or more. When the lower limit is less than 0.001 wt %, the addition effect is small. When the content of the dope material is more than 0.01 wt %, sinterability and processability are deteriorated, which causes a decrease in a mass production property.

When the content of Hf is defined as 100 parts by mass, the content of Zr is preferably 10 parts by mass or less. The content of Hf represents the total Hf amount of Hf and HfC. Since Zr (zirconium) has a high melting point of 1850° C., Zr hardly exerts an adverse influence even when Zr is contained in the tungsten part. Commercially available Hf powder may contain several ten percent of Zr, depending on the grade of the powder. It is effective to use high-purity Hf powder or high-purity HfC powder from which impurities have been removed in order to improve the characteristics. On the other hand, highly-purified raw material causes a cost increase. If the content of Zr (zirconium) is 10 parts by mass or less when the content of Hf is defined as 100 parts by weight, excessive deterioration of the characteristics can be prevented.

When the amount of carbon in a surface part in the tungsten alloy part is defined as C1 (wt %) and the amount of carbon in a central part is defined as C2 (wt %), $C1<C2$ is preferably set. The surface part means a portion located between the surface of the tungsten alloy and a point distant by 20 μm from the surface. The central part is a central portion in the section of the tungsten alloy part. The amount of carbon is a value obtained by adding both carbon of a carbide such as HfC, and independently existing carbon, and is analyzed by the combustion-infrared absorption method. The amount of carbon C1 in the surface part is smaller than the amount of carbon C2 in the central part means that carbon in the surface part is deoxidized into $CO_2$, which is discharged to the outside of the system. The decrease in the amount of carbon in the surface part causes a relative increase in the Hf amount in the surface part. For this reason, it is particularly effective when Hf is used as an emitter material.

The average crystal particle diameter of tungsten is preferably 1 to 100 μm. The tungsten alloy part is preferably a sintered body. When the tungsten alloy part is the sintered body, parts having various shapes can be prepared by utilizing a molding process. The sintered body is subjected to a forging process, a rolling process, and a wiredrawing process or the like, and thereby the sintered body is likely to be processed into a wire rod (including a filament) and a coil part or the like.

The tungsten crystals have an isotropic crystal structure in which the ratio of crystals having an aspect ratio of less than 3 is 90% or more in the sintered body. When the sintered body is subjected to the wiredrawing process, the tungsten crystals have a flat crystal structure in which the ratio of crystals having an aspect ratio of 3 or more is 90% or more. The particle diameters of the tungsten crystals are obtained as follows. A photograph of a crystal structure is taken by use of a metallurgical microscope or the like. A maximum Feret diameter is measured for one tungsten crystal imaged therein, and defined as a particle diameter. This measurement is performed for 100 arbitrary tungsten crystals, and the average value thereof is defined as an average crystal particle diameter.

When the average crystal particle diameter of tungsten is a small value of less than 1 μm, it is difficult to form a uniform dispersion state of a dispersed component such as Hf, HfC, or C. The dispersed component exists in the grain boundary between the tungsten crystals. Therefore, the grain boundary is small when the average crystal particle diameter of tungsten is a small value of less than 1 μm, which makes it difficult to uniformly disperse the dispersed component. On the other hand, when the average crystal particle diameter of tungsten is a large value of more than 100 μm, the strength as the sintered body is decreased. Therefore, the average crystal particle diameter of tungsten is preferably 1 to 100 μm, and more preferably 10 to 60 μm.

From the viewpoint of a uniform dispersion, the average particle diameter of the dispersed component such as Hf, HfC, or C is preferably smaller than the average crystal particle diameter of tungsten. A maximum Feret diameter is used also for the average particle diameter of the dispersed component. When the average crystal particle diameter of tungsten is defined as A (μm) and the average particle diameter of the dispersed component is defined as B (μm), $B/A\leq 0.5$ is preferably set. The dispersed component such as Hf, HfC, or C exists in the grain boundary between the tungsten crystals, and functions as an emitter material or a grain boundary reinforcing material. The average particle diameter of the dispersed component is decreased to ½ or less of the average crystal particle diameter of tungsten, and thereby the dispersed component is more likely to be uniformly dispersed in the grain boundary between the tungsten crystals, which can reduce variation in the characteristics.

The above tungsten alloy and tungsten alloy part are preferably used for at least one kind of a discharge lamp part, a transmitting tube part, and a magnetron part.

Figure 2:
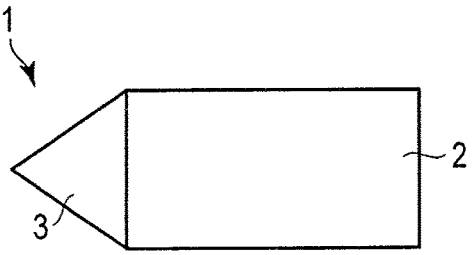
FIG. 2 shows another example of the tungsten alloy part of the first embodiment.

Examples of the discharge lamp part include a cathode electrode, an electrode supporting rod, and a coil part which are used for a discharge lamp. FIGS. 1 and 2 show an example of a discharge lamp cathode electrode. In FIGS. 1 and 2, numeral number 1 designates a cathode electrode; numeral number 2 designates an electrode body part; and numeral number 3 designates an electrode tip part. The cathode electrode 1 is formed by the sintered body of the tungsten alloy. The electrode tip part 3 may have a tip formed into a trapezoidal shape (truncated cone shape) as shown in FIG. 1 or a tip formed into a triangular shape (cone shape) as shown in FIG. 2. The tip part is subjected to polishing processing if needed. Preferably, the electrode body part 2 has a cylindrical shape, and has a diameter of 2 to 35 mm and a length of 10 to 600 mm.

Figure 3:
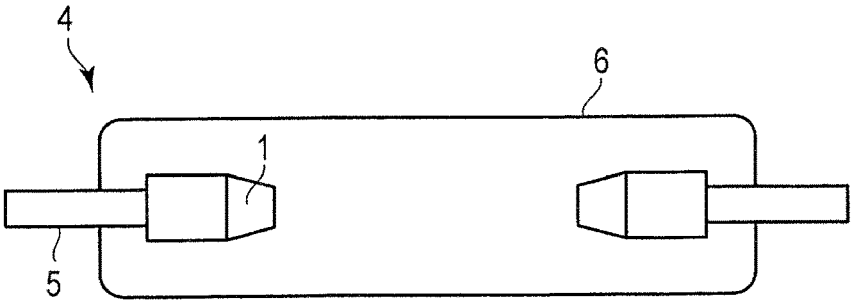
FIG. 3 shows an example of a discharge lamp of the first embodiment.

FIG. 3 shows an example of the discharge lamp. In FIG. 3, numeral number 1 designates a cathode electrode; numeral number 4 designates a discharge lamp; numeral number 5 designates an electrode supporting rod; and numeral number 6 designates a glass tube. In the discharge lamp 4, the pair of cathode electrodes 1 are disposed in a state where electrode tip parts face each other. The cathode electrode 1 is joined to the electrode supporting rod 5. A phosphor layer which is not shown is provided in the glass tube 6. A mercury, halogen, or argon gas (or neon gas) or the like is enclosed in the glass tube if needed.

When the tungsten alloy part of the embodiment is used as the electrode supporting rod 5, the whole electrode supporting rod may be the tungsten alloy of the embodiment. The tungsten alloy of the embodiment may be used for a portion of the electrode supporting rod joined to the cathode electrode and the remaining portion may be joined to another lead material.

The coil part may be attached to the electrode supporting rod depending on the kind of the discharge lamp, to produce the electrode. The tungsten alloy of the embodiment can also be applied to the coil part.

The tungsten alloy part of the embodiment is used for the discharge lamp of the embodiment. The kind of the discharge lamp is not particularly limited. The discharge lamp can be applied to both a low-pressure discharge lamp and a high-pressure discharge lamp. Examples of the low-pressure discharge lamp include various arc-discharge type discharge lamps such as for general lighting, special lighting used for a road or a tunnel or the like, a curing apparatus for a coating material, a UV curing apparatus, a sterilizer, and a light cleaning apparatus for a semiconductor or the like. Examples of the high-pressure discharge lamp include a processing apparatus for water supply and sewerage, general lighting, outdoor lighting for a stadium or the like, a UV curing apparatus, an exposure device for a semiconductor and a printed circuit board or the like, a wafer inspection apparatus, a high-pressure mercury lamp such as a projector, a metal halide lamp, an extra high pressure mercury lamp, a xenon lamp, and a sodium lamp.

The tungsten alloy part of the embodiment is suitable also for the transmitting tube part. Examples of the transmitting tube part include a filament or a mesh grid. The mesh grid may be obtained by knitting a wire rod in a mesh form or forming a plurality of holes in a sintered body plate.

Since the tungsten alloy part of the embodiment is used as the transmitting tube part in the transmitting tube of the embodiment, the transmitting tube has good characteristics.

Figure 4:
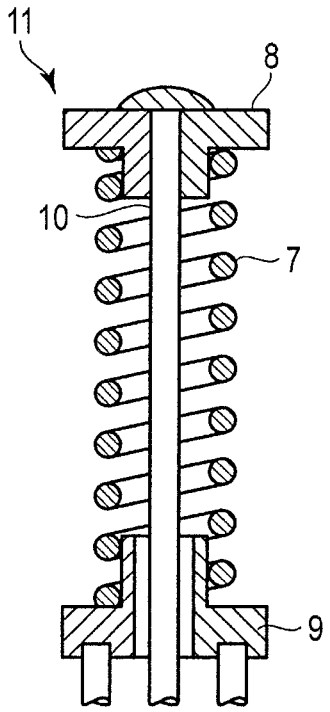
FIG. 4 shows an example of a magnetron part of the first embodiment.

The tungsten alloy part of the embodiment is suitable also for the magnetron part. Examples of the magnetron part include a coil part. FIG. 4 shows a magnetron cathode structure as an example of the magnetron part. In FIG. 4, numeral number 7 designates a coil part; numeral number 8 designates an upper supporting member; numeral number 9 designates a lower supporting member; numeral number 10 designates a supporting rod; and numeral number 11 designates a magnetron cathode structure. The upper supporting member 8 and the lower supporting member 9 are integrated with each other with the supporting rod 10 provided therebetween. The coil part 7 is disposed around the supporting rod 10, and integrated with the upper supporting member 8 and the lower supporting member 9. The magnetron part is suitable for a microwave oven. A tungsten wire material having a wire diameter of 0.1 to 1 mm is preferably used for the coil part. The diameter of the coil part is preferably 2 to 6 mm. When the tungsten alloy part of the embodiment is used for the magnetron part, the magnetron part exhibits excellent emission characteristics and excellent strength at high-temperature. Therefore, the reliability of the magnetron using the magnetron part can be improved.

Next, a method for producing the tungsten alloy and tungsten alloy part of the first embodiment will be described. As long as the tungsten alloy and tungsten alloy part of the first embodiment have the above constitution, the method for producing the tungsten alloy and the tungsten alloy part is not particularly limited. However, examples of the method for efficiently producing the tungsten alloy and the tungsten alloy part include the following method.

First, tungsten powder used as a raw material is prepared. The average particle diameter of the tungsten powder is preferably 1 to 10 μm. When the average particle diameter is less than 1 μm, the tungsten powder is apt to be aggregated, which makes it difficult to uniformly disperse the HfC component. When the average particle diameter is more than 10 μm, the average crystal particle diameter as the sintered body may be more than 100 μm. Although the purity of the tungsten powder depends on the intended application, the tungsten powder preferably has a high purity of 99.0 wt % or more, and more preferably 99.9 wt % or more.

Next, HfC powder is prepared as the HfC component. A mixture of Hf powder and carbon powder may be used instead of the HfC powder. Instead of HfC powder, a mixture obtained by mixing one or two kinds of the Hf powder or carbon powder with the HfC powder may be used. Of these, the HfC powder is preferably used. The HfC powder is partially decomposed in a sintering process, and obtained carbon reacts with an oxygen impurity in the tungsten powder to be changed into carbon dioxide. Carbon dioxide is discharged to the outside of the system. The HfC powder contributes to uniformity of the tungsten alloy, which is preferable. When the mixed powder of the Hf powder and carbon powder is used, a load in a production process is increased since both the Hf powder and the carbon powder must be uniformly mixed. Since metal Hf is apt to be oxidized, the HfC powder is preferably used.

The HfC component powder preferably has an average particle diameter of 0.5 to 5 μm. When the average particle diameter is less than 0.5 μm, the aggregation of the HfC powder is large, which makes it difficult to uniformly disperse the HfC powder. When the average particle diameter is more than 5 μm, it is difficult to uniformly disperse the HfC powder in the grain boundary between the tungsten crystals. From the viewpoint of obtaining a uniform dispersion, the average particle diameter of the HfC powder is preferably equal to or larger than the average particle diameter of the tungsten powder.

When the Hf amount is defined as 100 parts by mass in the HfC powder or Hf powder, the amount of Zr is preferably 10 parts by mass or less in the HfC powder or Hf powder. A Zr component may be contained as an impurity in the HfC powder or the Hf powder. When the amount of Zr is 10 parts by mass or less based on the Hf amount, degradation of excellent Hf component characteristics can be prevented. Although the amount of Zr is preferably small, highly-purified raw material causes a cost increase. Therefore, the amount of Zr is more preferably 0.1 to 3 parts by mass.

At least one dope material selected from K, Si, and Al is added if needed. The addition amount is preferably 0.01 wt % or less.

Next, raw powders are uniformly mixed. A mixing process is preferably performed by using a mixing machine such as a ball mill. The mixing process is preferably performed for 8 hours or more, and more preferably 20 hours or more. The raw powders may be mixed with an organic binder or an organic solvent if needed to produce a slurry. A granulation process may be performed if needed.

Next, the raw powders are pressed in a mold to prepare a molded body. The molded body is subjected to a degreasing process if needed. Next, a sintering process is performed. The sintering process is preferably performed under a reduction atmosphere such as a hydrogen atmosphere, under an inert atmosphere such as a nitrogen atmosphere, or in a vacuum. A sintering condition is preferably performed at a temperature of 1400 to 3000° C. for 1 to 20 hours. When the sintering temperature is less than 1400° C. or the sintering time is less than 1 hours, the sintering is insufficient, which decreases the strength of the sintered body. When the sintering temperature is more than 3000° C. or the sintering time is more than 20 hours, the tungsten crystals may overgrow. Carbon in the surface part of the sintered body is likely to be discharged to the outside of the system by sintering under an inert atmosphere or in a vacuum. The sintering process is not particularly limited to electric sintering, and pressureless sintering, pressure sintering or the like can also be used.

Next, a process of processing the sintered body (tungsten alloy) into a part is performed. Examples of the process of processing the sintered body into a part include a forging process, a rolling process, a wiredrawing process, a cutting process, and a polishing process. Examples of the process when the sintered body is processed into a coil part include a coiling process. Examples of the process when the mesh grid is prepared as the transmitting tube part include a process of weaving the filament in a mesh form.

Next, after the sintered body is processed into the part, the part is subjected to a stress relief heat treatment if needed. The stress relief heat treatment is preferably performed at 1300 to 2500° C. under a reduction atmosphere, under an inert atmosphere, or in a vacuum. The stress relief heat treatment is performed, and thereby an internal stress generated in the processing process to the part can be suppressed, which can enhance the strength of the part.

Second Embodiment

A second embodiment provides a tungsten alloy containing a W component, and a Hf component containing HfC particles, and a tungsten alloy part using the tungsten alloy, a discharge lamp using the tungsten alloy, a transmitting tube using the tungsten alloy, and a magnetron using the tungsten alloy. The content of the Hf component in terms of HfC is 0.1 wt % or more and 5 wt % or less. The average primary particle diameter of the HfC particles is 15 μm or less. The Hf component contains at least HfC. The Hf component may contain a HF-containing compound other than HfC, and a Hf simple substance or the like. Examples of the Hf-containing compound include $HfO_2$.

A discharge lamp electrode part of the second embodiment is made of a tungsten alloy. The tungsten alloy contains 0.1 to 5 wt % of the Hf component in terms of HfC, and the HfC particles in the Hf component have an average particle diameter of 15 μm or less.

Figure 5:
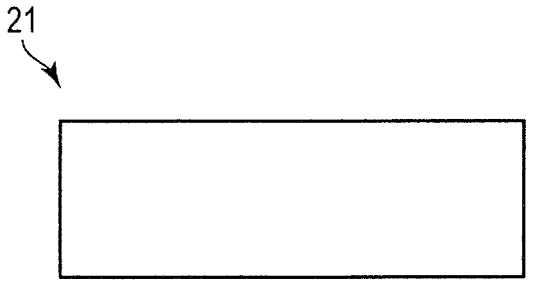
FIG. 5 shows an example of a discharge lamp electrode part of a second embodiment.
Figure 6:
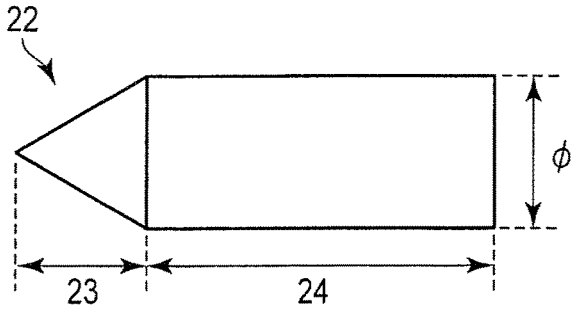
FIG. 6 shows another example of the discharge lamp electrode part of the second embodiment.

FIGS. 5 and 6 show an example of the discharge lamp electrode part of the embodiment. In FIGS. 5 and 6, numeral number 21 designates a discharge lamp electrode part; numeral number 22 designates a discharge lamp electrode part having a taper-shaped tip part; numeral number 23 designates a tip part; and numeral number 24 designates a body part. The discharge lamp electrode part 21 has a cylindrical shape. The tip part 23 of the discharge lamp electrode part 21 is tapered to produce the discharge lamp electrode part 22. Although the discharge lamp electrode part 21 before being tapered usually has a cylindrical shape, the discharge lamp electrode part 21 may have a quadrangular prism shape.

First, the tungsten alloy contains 0.1 to 5 wt % of the Hf component in terms of HfC. Examples of the Hf component include two kinds (HfC and Hf). The atomic ratio of C/Hf for HfC (hafnium carbide) is not limited to 1, and is within a range of 0.6 to 1. The tungsten alloy contains 0.1 to 5 wt % of the Hf component in terms of HfC (C/Hf atomic ratio=1). The Hf component is a component functioning as an emitter material in the discharge lamp electrode part. When the content of the Hf component is less than 0.1 wt % in terms of HfC, emission characteristics are insufficient. On the other hand, when the content of the Hf component is more than 5 wt %, a strength decrease or the like may be caused. Therefore, the amount of the Hf component is preferably 0.3 to 3.0 wt % in terms of HfC, and more preferably 0.5 to 2.5 wt %.

The Hf component can exist as HfC or Hf as described above. Of these, the primary particles of HfC need to have an average particle diameter of 15 μm or less. That is, it is important that HfC is a particulate matter. The HfC particles exist in the grain boundary between tungsten crystal particles. Therefore, when the HfC particles are too large, a clearance between the tungsten crystal particles is enlarged, which causes a density decrease and a strength decrease. When the HfC particles exist in the grain boundary between the tungsten crystal particles, the HfC particles function as not only an emission material but also a dispersion reinforcing material. Therefore, the strength enhancement of an electrode part is also obtained.

The primary particles of the HfC particles preferably have an average particle diameter of 5 μm or less and a maximum diameter of 15 μm or less. The HfC particles preferably have an average particle diameter of 0.1 to 3 μm. The HfC particles preferably have a maximum diameter of 1 to 10 μm. The small HfC particles having an average particle diameter of less than 0.1 μm or a maximum diameter of less than 1 μm may be consumed quickly and disappear due to emission. The HfC particles preferably have an average particle diameter of 0.1 μm or more or a maximum diameter of 1 μm or more in order to achieve a life improvement of the electrode.

For the dispersion state of the HfC particles, 2 to 30 particles preferably exist on an arbitrary straight line of 200 μm. When the number of the HfC particles is less than 2 (0 to 1 particle) per straight line of 200 μm, the HfC particles are partially decreased, which increases the variation in emission. On the other hand, when the number of the HfC particles is more than 30 (31 particles or more) per straight line of 200 μm, a part of the HfC particles may be excessively increased, to cause an adverse influence such as a strength decrease. The dispersion state of the HfC particles is measured by subjecting the arbitrary section of the tungsten alloy to magnification photography. The magnification ratio of the magnified photograph is set to 1000 times or more. An arbitrary straight line of 200 μm (line thickness: 0.5 mm) is drawn on the magnified photograph, and the number of the HfC particles existing on the line is counted.

The secondary particles of the HfC particles preferably have a maximum diameter of 100 μm or less. The secondary particle of the HfC particles is an agglomerate of the primary particles. When the diameter of the secondary particle is more than 100 μm, the strength of the tungsten alloy part is decreased. Therefore, the maximum diameter of the secondary particles of the HfC particles is preferably 100 μm or less, more preferably 50 μm or less, and still more preferably 20 μm or less.

Hf (metal Hf) of the Hf component has various dispersion states.

In a first dispersion state, metal Hf exists as particles. Metal Hf particles exist in the grain boundary between the tungsten crystal particles as in the HfC particles. The metal Hf particles exist in the grain boundary between the tungsten crystal particles, and thereby the metal Hf particles also function as the emission material and the dispersion reinforcing material. Therefore, the primary particle diameter of the metal Hf particles is preferably an average particle diameter of 15 μm or less, more preferably 10 μm or less, and still more preferably 0.1 to 3 μm. The maximum diameter is preferably 15 μm or less, and more preferably 10 μm or less. When the tungsten alloy is prepared, the HfC particles and the metal Hf particles may be previously mixed, or the HfC particles may be decarbonized into the metal Hf particles in the production process. When a method for decarbonizing the HfC particles is used, a deoxidation effect for reacting the HfC particles with oxygen in tungsten to discharge carbon dioxide to the outside of the system is also obtained, which is preferable. When the deoxidation is possible, the electrical resistance of the tungsten alloy can be decreased, which improves the conductivity of the electrode. A part of the metal Hf particles may be contained in $HfO_2$ particles.

In a second dispersion state, metal Hf exists on the surfaces of the HfC particles. As in the first dispersion state, when the sintered body of the tungsten alloy is prepared, carbon is removed from the surfaces of the HfC particles, which leads to a state in which a metal Hf film is formed on the surface. Even the HfC particles with the metal Hf film exhibit excellent emission characteristics. The primary particle diameter of the HfC particles with the metal Hf film is preferably an average particle diameter of 15 μm or less, more preferably 10 μm or less, and still more preferably 0.1 to 3 μm. The maximum diameter is preferably 15 μm or less, and more preferably 10 μm or less.

In a third dispersion state, at least part of metal Hf is solid-solved in tungsten. Metal Hf forms a solid solution with tungsten. The strength of the tungsten alloy can be enhanced by forming the solid solution. The presence or absence of the solid solution can be measured by XRD analysis. First, the contents of the Hf component and carbon are measured. The amounts of Hf and carbon in the Hf component are converted into HfC, to confirm $HfC_x$ ($x<1$). Next, the XRD analysis is performed to confirm that the peak of metal Hf is not detected. $HfC_x$ ($x<1$) is confirmed, and although hafnium which is not contained in hafnium carbide exists, the peak of metal Hf is not detected. This means that metal Hf is solid-solved in tungsten.

On the other hand, $HfC_x$ ($x<1$) is set; hafnium which is not contained in hafnium carbide exists; and the peak of metal Hf is detected. This means the first dispersion state where metal Hf is not solid-solved and exists in the grain boundary between the tungsten crystals. The second dispersion state can be analyzed by using EPMA (electron beam microanalyzer) or TEM (transmission electron microscope).

The dispersion state of metal Hf may be any one kind or a combination of two or more kinds of the first dispersion state, the second dispersion state, and the third dispersion state.

When the total content of the Hf component (the content of Hf) is defined as 100 parts by mass, the ratio of Hf to be contained in the HfC particles is preferably 25 to 75 parts by mass. Naturally, the whole of Hf component may be the HfC particles. The emission characteristics are obtained by use of the HfC particles. On the other hand, the conductivity and strength of the tungsten alloy can be enhanced by dispersing metal Hf. However, when all the Hf component is metal Hf, the emission characteristics and the strength at high-temperature are decreased. Metal Hf has a melting point of 2230° C.; HfC has a melting point of 3920° C.; and metal tungsten has a melting point of 3400° C. Since HfC has a higher melting point, the high-temperature strength of the tungsten alloy containing a predetermined amount of HfC is enhanced. Since HfC has a surface current density nearly equal to that of $ThO_2$, electric current equal to that of a thorium oxide-containing tungsten alloy can be passed through the tungsten alloy. Therefore, a current density equal to that of a thorium oxide-containing tungsten alloy electrode can be set as the discharge lamp, which eliminates the design change of a control circuit or the like. Therefore, when the total content of the Hf component is defined as 100 parts by mass, the ratio of the HfC particles is preferably 25 to 75 parts by mass, and more preferably 35 to 65 parts by mass.

In a method for analyzing the contents of HfC and metal Hf, the total amount of Hf in the tungsten alloy is measured according to the ICP analysis method. Next, the total amount of carbon in the tungsten alloy is measured by a combustion-infrared absorption method. When the tungsten alloy is a binary system containing the Hf component, the measured total amount of carbon may be considered to be contained in HfC. Therefore, the amount of HfC in the Hf component can be measured by comparison of the measured total amount of Hf with the total amount of carbon. In the case of using this method, the amount of HfC is calculated by C/Hf=1.

For the measurement of the sizes of the HfC particles, a magnified photograph of an arbitrary section of the tungsten alloy sintered body is taken, and the longest diagonal line of the HfC particles imaged therein is measured as the particle diameter of the HfC particle. In this work, 50 HfC particles are measured, to define the average value thereof as the average particle diameter of the HfC particles. The maximum value of the particle diameters (the longest diagonal lines) of the HfC particles is defined as the maximum diameter of the HfC particles.

The tungsten alloy may contain 0.01 wt % or less of a dope material made of at least one kind of K, Si, and Al. K (potassium), Si (silicon), and Al (aluminum) are so-called dope materials. Recrystallization characteristics can be improved by adding these dope materials. The recrystallization characteristics are improved, and thereby a uniform recrystallized structure is likely to be obtained when a recrystallization heat treatment is performed. Although the lower limit of the content of the dope material is not particularly limited, the lower limit is preferably 0.001 wt % or more. When the lower limit is less than 0.001 wt %, the addition effect is small. When the content of the dope material is more than 0.01 wt %, sinterability and processability are deteriorated, which causes a decrease in a mass production property.

The tungsten alloy may contain 2 wt % or less of at least one element of Ti, Zr, V, Nb, Ta, Mo, and rare earth elements. At least one kind of Ti, Zr, V, Nb, Ta, Mo, and rare earth elements is any one kind of a metal simple substance, oxide, and carbide. The tungsten alloy may contain two or more kinds of elements. Even if the tungsten alloy contains two or more kinds of elements, the total amount thereof is preferably 2 wt % or less. These contained components mainly function as the dispersion reinforcing material. Since the HfC particles function as the emission material, the HfC particles are consumed when the discharge lamp is used for a long time. Since Ti, Zr, V, Nb, Ta, Mo, and rare earth elements have weak emission characteristics, these elements are less consumed by emission, and can maintain their function as a dispersion reinforcing material over a long period of time. Although the lower limits of the contents thereof are not particularly limited, the lower limits are preferably 0.01 wt % or more. Of these components, Zr and the rare earth elements are preferable. Since these components have a large atomic radius of 0.16 nm or more, the components have a large surface current density. In other words, a metal simple substance containing an element having an atomic radius of 0.16 nm or more or a compound of the element is said to be preferable.

The discharge lamp electrode part preferably has a tip part having a tapered tip and a cylindrical body part. The characteristics of the discharge lamp electrode part are improved by tapering, that is, sharpening the tip part. As shown in FIG. 6, the ratio of the length of the tip part 23 to that of the body part 24 is not particularly limited, and is determined in accordance with the application.

The wire diameter ϕ of the discharge lamp electrode part is preferably 0.1 to 30 mm. When the wire diameter ϕ is less than 0.1 mm, the strength of the electrode part cannot be maintained, which may lead to breakage of the electrode part when the electrode part is incorporated into the discharge lamp or breakage of the electrode part when the tip part is tapered. When the wire diameter ϕ is a large value of more than 30 mm, it is difficult to control the uniformity of the tungsten crystal structure, as described below.

Figure 7:
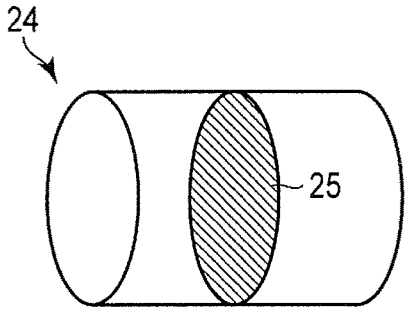
FIG. 7 shows an example of a circumferential section of a body part of the discharge lamp electrode part of the second embodiment.

When the crystal structure of the circumferential section (transverse section) of the body part is observed, the area ratio of the tungsten crystals having a crystal particle diameter of 1 to 80 μm per unit area of 300 μm×300 μm is preferably 90% or more. FIG. 7 shows an example of the circumferential section of the body part. In FIG. 7, numeral number 24 designates a body part; and numeral number 25 designates a circumferential section. When the crystal structure of the circumferential section is measured, a magnified photograph of the section in the center of the length of the body part is taken. When the wire diameter is thin, and a unit area of 300 μm×300 μm cannot be measured in one viewing field, an arbitrary circumferential section is photographed a plurality of times. In the magnified photograph, the longest diagonal line of the tungsten crystal particles imaged therein is defined as the maximum diameter. The area percent of the tungsten crystal particles having a maximum diameter falling within a range of 1 to 80 μm is measured.

The area ratio of the tungsten crystals having a crystal particle diameter of 1 to 80 μm per unit area of the circumferential section of the body part can be 90% or more. This shows that the small tungsten crystals having a crystal particle diameter of less than 1 μm and the large tungsten crystals having a crystal particle diameter of more than 80 μm are few. When the tungsten crystals of less than 1 μm are too many, the grain boundary between the tungsten crystal particles is too small. When the ratio of the HfC particles is increased in the grain boundary, and the HfC particles are consumed by emission, large defects are formed, which decreases the strength of the tungsten alloy. On the other hand, when the number of large tungsten crystal particles of more than 80 μm is increased, the grain boundary is too large, which decreases the strength of the tungsten alloy. The area ratio of the tungsten crystals having a crystal particle diameter of 1 to 80 μm is more preferably 96% or more, and still more preferably 100%.

The average particle diameter of the tungsten crystal particles in the circumferential section is preferably 50 μm or less, and more preferably 20 μm or less. The average aspect ratio of the tungsten crystal particles is preferably less than 3. The aspect ratio is measured as follows. A magnified photograph of unit area of 300 μm×300 μm is taken; the maximum diameter (Feret diameter) of the tungsten crystal particles imaged therein is defined as a major axis L; the particle diameter vertically extending from the center of the major axis L is defined as a minor axis S; and an aspect ratio is obtained by dividing L by S (major axis L/minor axis S). This measurement is performed for 50 tungsten crystal particles, and the average value thereof is defined as the average aspect ratio. When the average particle diameter is obtained, and (major axis L+minor axis S)/2=particle diameter is set, the average value of the 50 tungsten crystal particles is defined as the average particle diameter.

Figure 8:
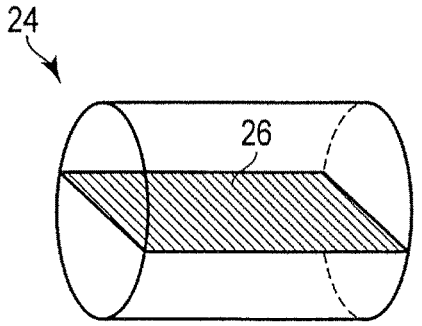
FIG. 8 shows an example of a side section of the body part of the discharge lamp electrode part of the second embodiment.

When the crystal structure of the side section (vertical section) of the body part is observed, the area ratio of the tungsten crystals having a crystal particle diameter of 2 to 120 μm per unit area of 300 μm×300 μm is preferably 90% or more. FIG. 8 shows an example of the side section. In FIG. 8, numeral number 24 designates a body part; and numeral number 26 designates a side section. When the crystal structure of the side section is measured, the section passing through the center of the wire diameter of the body part is measured. When a unit area of 300 μm×300 μm cannot be measured in one viewing field, an arbitrary side section is photographed a plurality of times. In the magnified photograph, the longest diagonal line of the tungsten crystal particles imaged therein is defined as the maximum diameter. The area percent of the tungsten crystal particles having a maximum diameter falling within a range of 2 to 120 μm is measured.

The area ratio of the tungsten crystals having a crystal particle diameter of 2 to 120 μm per unit area of the side section of the body part can be 90% or more. This shows that the small tungsten crystals having a crystal particle diameter of less than 2 μm and the large tungsten crystals having a crystal particle diameter of more than 120 μm are few. When the tungsten crystals of less than 2 μm are too many, the grain boundary between the tungsten crystal particles is too small. When the ratio of the HfC particles is increased in the grain boundary, and the HfC particles are consumed by emission, large defects are formed, which decreases the strength of the tungsten alloy. On the other hand, when the number of large tungsten crystal particles of more than 120 μm is increased, the grain boundary is too large, which decreases the strength of the tungsten alloy. The area ratio of the tungsten crystals having a crystal particle diameter of 2 to 120 μm is more preferably 96% or more, and still more preferably 100%.

The average particle diameter of the tungsten crystal particles in the side section is preferably 70 μm or less, and more preferably 40 μm or less. The average aspect ratio of the tungsten crystal particles is preferably 3 or more. A method for measuring the average particle diameter and the average aspect ratio is the same as that for the circumferential section.

As described above, a tungsten alloy having excellent discharge characteristics and strength, strength at high temperature can be provided by controlling the sizes of the tungsten crystal particles, and the size and ratio of the Hf component. Therefore, the characteristics of the discharge lamp electrode part are also improved.

The tungsten alloy preferably has a relative density of 95.0% or more, and more preferably 98.0% or more. When the relative density is less than 95.0%, air bubbles are increased, which may cause adverse influences such as a strength decrease and partial discharge. The relative density is a value obtained by dividing a measured density according to an Archimedes method by a theoretical density. (Measured density/theoretical density)×100 (%)=relative density is set. The theoretical density is obtained by calculation according to the mass ratios of tungsten, hafnium, and hafnium carbide. The theoretical density of tungsten is 19.3 $g/cm^3$; the theoretical density of hafnium is 13.31 $g/cm^3$; and the theoretical density of hafnium carbide is 12.2 $g/cm^3$. For example, in the case of a tungsten alloy containing 1 wt % of HfC, 0.2 wt % of Hf, and the remainder being tungsten, the theoretical density is $12.2\times0.01+13.31\times0.002+19.3\times0.988=19.21702$ $g/cm^3$. When the theoretical density is calculated, the existence of impurities may not be considered.

The tungsten alloy preferably has a Vickers hardness of Hv 330 or more, and more preferably Hv 330 to 700. When the Vickers hardness is less than Hv 330, the tungsten alloy is too soft, which decreases the strength. On the other hand, when the Vickers hardness is more than Hv 700, the tungsten alloy is too hard, which makes it difficult to process the tip part into a taper shape. When the tungsten alloy is too hard, an electrode part having a long body part has no flexibility, and may be apt to be broken. The three point bending strength of the tungsten alloy can be increased to 400 MPa or more.

The surface roughness Ra of the discharge lamp electrode part is preferably 5 μm or less. Particularly, the tip part preferably has a surface roughness Ra of 5 μm or less, and more preferably 3 μm or less. When surface unevenness is large, emission characteristics are deteriorated.

The above discharge lamp electrode part can be applied to various discharge lamps. Therefore, even if a large voltage of 100 V or more is applied, a long life can be achieved. The discharge lamps to be used are not particularly limited to the low-pressure discharge lamp and the high-pressure discharge lamp or the like. The wire diameter of the body part is within a range of 0.1 to 30 mm. The wire diameter capable of being applied is a thin size of 0.1 mm or more and 3 mm or less, a medium size of more than 3 mm and 10 mm or less, and a thick size of more than 10 mm and 30 mm or less. The length of the electrode body part is preferably 10 to 600 mm.

Figure 9:
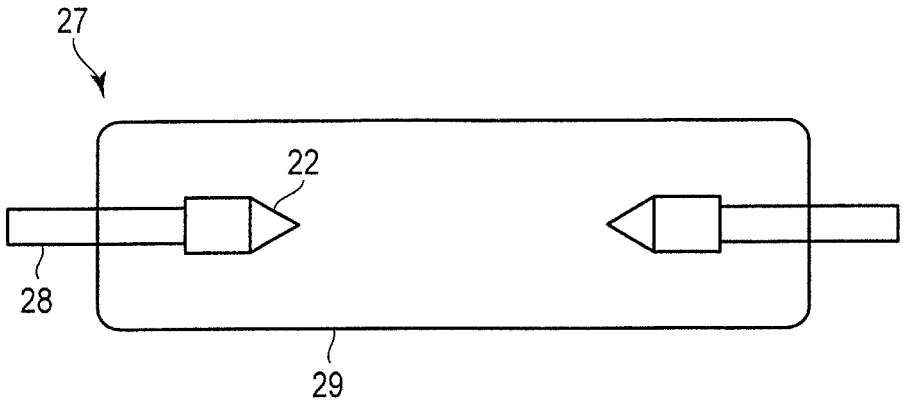
FIG. 9 shows an example of a discharge lamp of the second embodiment.

FIG. 9 shows an example of the discharge lamp. In FIG. 9, numeral number 22 designates an electrode part (having a tapered tip part); numeral number 27 designates a discharge lamp; numeral number 28 designates an electrode supporting rod; and numeral number 29 designates a glass tube. In the discharge lamp 27, the pair of electrode parts 22 are disposed in a state where electrode tip parts face each other. The electrode parts 22 are joined to the electrode supporting rod 28. A phosphor layer which is not shown is provided on the inner surface of the glass tube 29. A mercury, halogen, or argon gas (or neon gas) or the like is enclosed in the glass tube if needed.

The tungsten alloy and electrode part of the second embodiment are used for the discharge lamp of the embodiment. The kind of the discharge lamp is not particularly limited. The discharge lamp can be applied to both a low-pressure discharge lamp and a high-pressure discharge lamp. Examples of the low-pressure discharge lamp include various arc-discharge type discharge lamps such as for general lighting, special lighting used for a road and a tunnel or the like, a curing apparatus for a coating material, a UV curing apparatus, a sterilizer, and a light cleaning apparatus for a semiconductor or the like. Examples of the high-pressure discharge lamp include a processing apparatus for water supply and sewerage, general lighting, outdoor lighting for a stadium or the like, a UV curing apparatus, an exposure device for a semiconductor and a printed circuit board or the like, a wafer inspection apparatus, a high-pressure mercury lamp such as a projector, a metal halide lamp, an extra high pressure mercury lamp, a xenon lamp, and a sodium lamp. Since the strength of the tungsten alloy is improved, the discharge lamp can also be applied to a field involving movement (vibration) such as an automotive discharge lamp.

Next, a production method will be described. As long as the tungsten alloy and discharge lamp electrode part of the second embodiment have the above constitution, the production method is not particularly limited. However, examples of the production method for efficiently obtaining the tungsten alloy and the discharge lamp electrode part include the following method.

First, tungsten alloy powder containing a Hf component is prepared as a method for producing a tungsten alloy.

First, HfC powder is prepared as the Hf component. The primary particles of the HfC particles preferably have an average particle diameter of 15 μm or less, and more preferably an average particle diameter of 5 μm or less. Preferably, HfC particles having a maximum diameter of more than 15 μm are previously removed by using a sieve. When a maximum diameter is desired to be set to 10 μm or less, large HfC particles are removed by using a sieve having an intended mesh diameter. When the HfC particles having a small particle diameter are desired to be removed, the HfC particles are removed by using a sieve having an intended mesh diameter. Before sieving, the HfC particles are preferably subjected to a pulverizing process in a ball mill or the like. Since the aggregate can be broken by performing the pulverizing process, particle diameter control according to sieving is likely to be performed.

Next, a process of mixing metal tungsten powder is performed. The metal tungsten powder preferably has an average particle diameter of 0.5 to 10 μm. The tungsten powder preferably has purity of 98.0 wt % or more, an oxygen content of 1 wt % or less, and an impurity metal component of 1 wt % or less. It is preferable that the metal tungsten powder is previously pulverized in a ball mill or the like as in the HfC particles, and small particles and large particles are removed in a sieving process.

The metal tungsten powder is added so that the amount of the Hf component is set to an intended amount (0.1 to 3 wt % in terms of HfC) when being converted into HfC. A mixed powder of HfC particles and metal tungsten powder is put into a mixing vessel, and the mixing vessel is rotated, to uniformly mix the mixed powder. At this time, the mixed powder can be smoothly mixed by using a cylindrical mixing vessel as the mixing vessel, and rotating the cylindrical mixing vessel in a circumferential direction. The tungsten powder containing the HfC particles can be prepared by this process. In consideration of decarburization during a sintering process to be described below, a small amount of carbon powder may be added. At this time, the amount of the carbon powder to be added is set to be equal to or less than the same amount as the amount of carbon to be decarbonized.

Next, a molded body is prepared by using the obtained tungsten powder containing the HfC particles. When the molded body is formed, a binder is used if needed. When a cylindrical molded body is formed, the diameter of the molded body is preferably 0.1 to 40 mm. When a molded body is cut out from a plate-like sintered body as described below, the size of the molded body is arbitrary. The length (thickness) of the molded body is arbitrary.

Next, a process of presintering the molded body is performed. The presintering is preferably performed at 1250 to 1500° C. A presintered body can be obtained by this process. Next, a process of subjecting the presintered body to electric sintering is performed. The electric sintering is preferably performed so that the temperature of the sintered body is set to 2100 to 2500° C. When the temperature is less than 2100° C., the sintered body cannot be sufficiently densified, which decreases the strength. When the temperature is more than 2500° C., the HfC particles and the tungsten particles overgrow, and the intended crystal structure is not obtained.

Examples of another method include a method for sintering the molded body at a temperature of 1400 to 3000° C. for 1 to 20 hours. When the sintering temperature is less than 1400° C. or the sintering time is less than 1 hour, the sintering is insufficient, which decreases the strength of the sintered body. When the sintering temperature is more than 3000° C. or the sintering time is more than 20 hours, the tungsten crystals may overgrow.

Examples of the sintering atmosphere include an inert atmosphere such as a nitrogen or argon atmosphere, a reducing atmosphere such as a hydrogen atmosphere, and a vacuum. Under any of these atmospheres, carbon in the HfC particles is removed during the sintering process. Since an oxygen impurity in the tungsten powder is also removed during decarbonization, the oxygen content in the tungsten alloy can be decreased to 1 wt % or less, and further to 0.5 wt % or less. When the oxygen content in the tungsten alloy is decreased, the conductivity is improved.

A Hf component-containing tungsten sintered body can be obtained by the sintering process. When the presintered body has a cylindrical shape, the sintered body is also a cylindrical sintered body (ingot). In the case of the plate-like sintered body, a process of cutting out the plate-like sintered body into a predetermined size is performed. The cylindrical sintered body (ingot) is obtained by the cutting-out process.

Next, there is performed a process of subjecting the cylindrical sintered body (ingot) to forging processing, rolling processing, and wiredrawing processing or the like, to adjust the wire diameter. A processing ratio in that case is preferably within a range of 30 to 90%. When the sectional area of the cylindrical sintered body before processing is defined as A and the sectional area of the cylindrical sintered body after processing is defined as B, the processing ratio is obtained by the processing ratio of $[(A-B)/A]\times100\%$. The wire diameter is preferably adjusted by a plurality of such processes. The pores of the cylindrical sintered body before processing can be crushed by performing the plurality of such processes, to obtain a high-density electrode part.

Next will be described a case where a cylindrical sintered body having a diameter of 25 mm is processed into a cylindrical sintered body having a diameter of 20 mm, for example. Since the sectional area A of a circle having a diameter of 25 mm is 460.6 $mm^2$ and the sectional area B of a circle having a diameter of 20 mm is 314 $mm^2$, the processing ratio is $32\%=[(460.6-314)/460.6]\times100\%$. At this time, the diameter of the cylindrical sintered body is preferably processed to 20 mm from 25 mm by a plurality of wiredrawing processings or the like.

When the processing ratio is a low value of less than 30%, the crystal structure is not sufficiently stretched in the processing direction, which makes it difficult to set the tungsten crystals and the thorium component particles at the intended size. When the processing ratio is a small value of less than 30%, the pores in the cylindrical sintered body before processing are not sufficiently crushed, and may remain as is. The remaining internal pores cause a decrease in the durability or the like of a cathode part. On the other hand, when the processing ratio is a large value of more than 90%, the sintered body is excessively processed, which may cause disconnections and decrease the yield. For this reason, the processing ratio is 30 to 90%, and preferably 35 to 70%.

When the relative density of the sintered tungsten alloy is 95% or more, the sintered tungsten alloy may not be necessarily processed at a predetermined processing ratio.

After the wire diameter is processed to 0.1 to 30 mm, the electrode part is prepared by cutting the sintered body to a required length. The tip part is processed into a taper shape if needed. Polishing processing, a heat treatment (recrystallization heat treatment or the like), and shape processing are performed if needed.

The recrystallization heat treatment is preferably performed at 1300 to 2500° C. under a reducing atmosphere, under an inert atmosphere, or in a vacuum. The effect of the stress relief heat treatment suppressing the internal stress generated in the processing process to the electrode part is obtained by performing the recrystallization heat treatment, and the strength of the part can be enhanced.

The above production method can efficiently produce the tungsten alloy and discharge lamp electrode part of the embodiment.

In the tungsten alloy of the first embodiment, further improvement in the emission characteristics can be expected by specifying the physical properties described in the second embodiment, or specifying the physical properties described in the first embodiment in the tungsten alloy of the second embodiment. For example, in the tungsten alloy of the first embodiment, the emission characteristics can be improved by specifying any of the primary particle diameter and secondary particle diameter of the HfC particles, the dispersion state of metal Hf, the ratio of Hf contained into HfC, the relative density, and the Vickers hardness as in the second embodiment. In the tungsten alloy part of the first embodiment, the emission characteristics can be improved by specifying the crystallized structure of the section and the surface roughness Ra as in the second embodiment.

EXAMPLES

Example 1

As raw powders, 1.5 wt % of HfC powder (purity: 99.0%) of which an average particle diameter of primary particle diameters was 2 μm was added to tungsten powder (purity: 99.99 wt %) having an average particle diameter of 2 μm. When the amount of Hf for the HfC powder was defined as 100 parts by mass, the amount of impurity Zr was 0.8 parts by mass.

The raw powders were mixed in a ball mill for 12 hours, to prepare a mixed raw powder. Next, the mixed raw powder was put into a mold, to produce a molded body. The obtained molded body was subjected to furnace sintering under a hydrogen atmosphere at 1800° C. for 10 hours. A sintered body having a height of 16 mm, a width of 16 mm, and a length of 420 mm was obtained by the process.

Next, a cylindrical sample having a diameter of 2.4 mm and a length of 150 mm was cut out. The sample was subjected to centerless polishing processing, to set a surface roughness Ra to 5 μm or less. Next, as a stress relief heat treatment, a heat treatment was performed under a hydrogen atmosphere at 1600° C.

Thereby, a discharge lamp cathode part was prepared as a tungsten alloy part according to Example 1.

Comparative Example 1

A discharge lamp cathode part was prepared, which was made of a tungsten alloy containing 2 wt % of $ThO_2$ and had the same size.

The content of a HfC component, the amounts of carbon in a surface part and a central part, and the average particle diameter of tungsten crystals were investigated for the tungsten alloy part according to Example 1. For the analysis of the content of the HfC component, the content of Hf and the amount of carbon were analyzed by ICP analysis or a combustion-infrared absorption method, and converted into $HfC_x$. The amounts of carbon in the surface part and the central part were analyzed as follows. Measurement samples were cut out from a range between a surface and a position distant by 10 μm from the surface and a cylindrical section, and the amounts of carbon were measured. The average value of the maximum Feret diameters of 100 tungsten crystals measured in an arbitrary sectional structure was defined as the average crystal particle diameter of tungsten. The results are shown in Table 1.

TABLE 1

| | In terms of HfC (wt %) | x value when converted into $HfC_x$ | Amount of carbon in surface part (wt %) | Amount of carbon in central part (wt %) | Average crystal particle diameter of tungsten (μm) |
|---|---|---|---|---|---|
| Example 1 | 1.5 | 0.5 | 0.60 | 0.78 | 34 |

Next, there were investigated the emission characteristics of the discharge lamp cathode parts according to Example 1 and Comparative Example 1. For the measurement of the emission characteristics, emission current densities (mA/mm$^2$) were measured by changing an applied voltage (V) to 100 V, 200 V, 300 V, and 400 V. The emission current densities were measured under conditions of an electric current load of 18±0.5 A/W applied to the cathode part and an applied time of 20 ms. The results are shown in FIG. 10.

Figure 10:
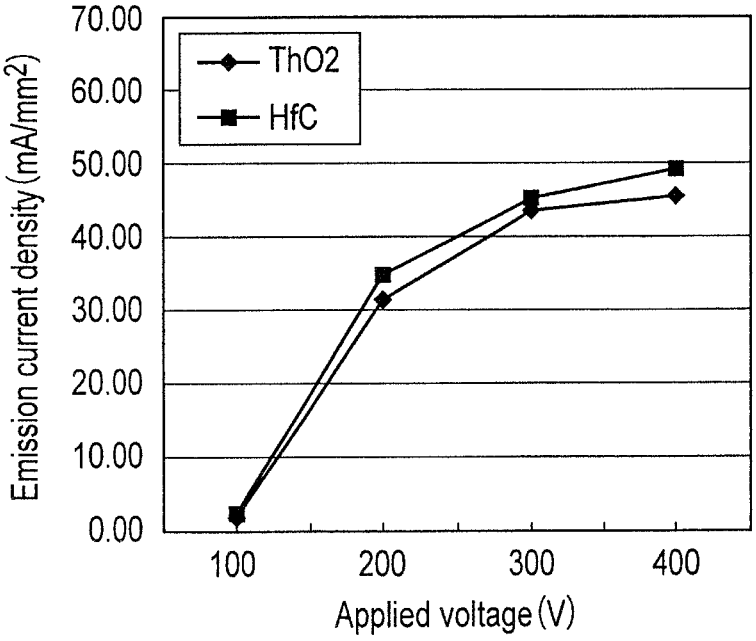
FIG. 10 shows the relationship between an emission current density and an applied voltage of Example 1 and Comparative Example 1.

As can be seen from FIG. 10, it was found that Example 1 has more excellent emission characteristics than those of Comparative Example 1. As a result, it is found that the discharge lamp cathode part of Example 1 exhibits excellent emission characteristics without using thorium oxide which is a radioactive material. The temperature of the cathode part was 2100 to 2200° C. during measurement. For this reason, it is found that the cathode part according to Example 1 has excellent strength at high temperature and an excellent life or the like.

Examples 2 to 5

Next, there were prepared raw mixed powders in which the addition amount of HfC and the addition amount of K as a dope material were changed as shown in Table 2. The raw mixed powders were subjected to metal molding, and sintered under a hydrogen atmosphere at 1500 to 1900° C. for 7 to 16 hours, to obtain sintered bodies. In Examples 2 and 3, a cutting-out process was performed under a condition where the size of the sintered body was the same as that of Example 1. In Examples 4 and 5, the sizes of the molded bodies were adjusted, to directly obtain sintered bodies having a diameter of 2.4 mm and a length of 150 mm.

Each of the samples was subjected to centerless polishing processing to set a surface roughness Ra to 5 μm or less. Next, as a stress relief heat treatment, a heat treatment was performed under a hydrogen atmosphere at 1400 to 1700° C. Thereby, discharge lamp cathode parts according to Examples 2 to 5 were prepared, and measured in the same manner as in Example 1. The results are shown in Table 3.

TABLE 2

| | Addition amount of HfC | Addition amount of K |
|---|---|---|
| Example 2 | 0.6 | None |
| Example 3 | 1.0 | None |
| Example 4 | 2.5 | 0.005 |
| Example 5 | 1.3 | None |

TABLE 3

| | In terms of HfC (wt %) | x value when converted into $HfC_x$ | Amount of carbon in surface part (wt %) | Amount of carbon in central part (wt %) | Average crystal particle diameter of tungsten (μm) |
|---|---|---|---|---|---|
| Example 2 | 0.6 | 0.61 | 0.020 | 0.025 | 28 |
| Example 3 | 1.0 | 0.46 | 0.026 | 0.030 | 65 |
| Example 4 | 2.5 | 0.44 | 0.066 | 0.069 | 52 |
| Example 5 | 1.3 | 0.51 | 0.040 | 0.045 | 42 |

Next, emission characteristics were estimated under the same condition as that of Example 1. The results are shown in Table 4.

TABLE 4

| | Emission current density (mA/mm$^2$) | | | |
|---|---|---|---|---|
| | Applied Voltage 100 V | Applied Voltage 200 V | Applied Voltage 300 V | Applied Voltage 400 V |
| Example 2 | 1.76 | 32.1 | 43.1 | 45.1 |
| Example 3 | 1.98 | 32.5 | 44.6 | 47.5 |
| Example 4 | 2.24 | 36.6 | 48.5 | 50.2 |
| Example 5 | 2.12 | 34.6 | 44.8 | 48.8 |

As can be seen from Table 4, the discharge lamp cathode parts according to the present Examples exhibited excellent characteristics. The temperatures of the cathode parts were 2100 to 2200° C. during measurement. For this reason, it is found that the cathode parts according to Examples 2 to 5 have excellent strength at high temperature and an excellent life or the like.

Examples 11 to 20 and Comparative Example 11

Tungsten powder (purity: 99.0 wt % or more) and HfC powder shown in Table 5 were prepared as raw powders. The powders were sufficiently loosened in a ball mill, and subjected to a sieving process so that the maximum diameters thereof were set to values shown in Table 5 if needed.

TABLE 5

| | Tungsten Powder | | | | HfC Powder | |
|---|---|---|---|---|---|---|
| | Average Particle Diameter (μm) | Maximum Diameter (μm) | Oxygen Content (wt %) | Carbon Content (wt %) | Average Particle Diameter of Primary Particles (μm) | Maximum Diameter of Secondary Particles (μm) |
| Example 11 | 1 | 5 | 0.2 | <0.01 | 1.2 | 7.0 |
| Example 12 | 2 | 8 | 0.2 | <0.01 | 2.5 | 8.0 |
| Example 13 | 3 | 10 | 0.2 | <0.01 | 4.5 | 10.0 |
| Example 14 | 5 | 18 | 0.8 | <0.01 | 4.7 | 10.0 |
| Example 15 | 8 | 30 | 0.8 | <0.01 | 8.3 | 13.0 |
| Example 16 | 2 | 6 | 0.5 | <0.01 | 2.4 | 6.0 |
| Example 17 | 3 | 8 | 0.5 | <0.01 | 3.2 | 8.5 |
| Example 18 | 2 | 6 | 0.1 | <0.01 | 0.7 | 3.5 |
| Example 19 | 2 | 6 | 0.1 | <0.01 | 0.7 | 3.5 |
| Example 20 | 2 | 6 | 0.1 | <0.01 | 0.7 | 3.5 |
| Comparative Example 11 | 5 | 40 | 0.8 | <0.01 | 20 | 50 |

Next, the tungsten powder and the HfC powder were mixed at ratios shown in Table 6, and mixed in the ball mill again. Next, the mixtures were molded to prepare molded bodies. Next, a sintering process was performed under conditions shown in Table 6. Sintered bodies having a height of 16 mm, a width of 16 mm, and a length of 420 mm were obtained.

TABLE 6

| Amount of Hf component (in terms of HfC, wt %) | | Sintering process |
|---|---|---|
| Example 11 | 0.5 | Under nitrogen atmosphere, presintering, 1400° C. → Electric sintering, 2300° C. |
| Example 12 | 1.0 | Under hydrogen atmosphere, presintering, 1350° C. → Electric sintering, 2200° C. |
| Example 13 | 1.5 | Under hydrogen atmosphere, furnace sintering, 1900° C. |
| Example 14 | 2.0 | Under nitrogen atmosphere, presintering, 1450° C. → Electric sintering, 2200° C. |
| Example 15 | 2.5 | Under hydrogen atmosphere, furnace sintering, 1800° C. |
| Example 16 | 1.5 | Under hydrogen atmosphere, presintering, 1400° C. → Electric sintering, 2250° C. |

TABLE 6-continued

| Amount of Hf component (in terms of HfC, wt %) | | Sintering process |
|---|---|---|
| Example 17 | 1.0 | Under hydrogen atmosphere, furnace sintering, 1950° C. |
| Example 18 | 0.8 | Under nitrogen atmosphere, presintering, 1430° C. → Electric sintering, 2250° C. |
| Example 19 | 0.2 | Under hydrogen atmosphere, presintering, 1420° C. → Electric sintering, 2200° C. |
| Example 20 | 4.5 | Under hydrogen atmosphere, furnace sintering, 2000° C. |
| Comparative Example 11 | 2.5 | Under hydrogen atmosphere, furnace sintering, 1800° C. |

Next, cylindrical sintered bodies (ingots) were cut out from the obtained tungsten alloy sintered bodies, and the wire diameters were adjusted by appropriately combining forging processing, rolling processing, and wiredrawing processing. Processing ratios were as shown in Table 7. The wire diameters were adjusted. Then, the sintered bodies were cut to a predetermined length, and the tip parts were processed into a taper shape. Then, the sintered bodies were subjected to surface polishing, to set surface roughnesses Ra to 5 μm or less. Next, the sintered bodies were subjected to a recrystallization heat treatment at 1600° C. under a hydrogen atmosphere. Thereby, discharge lamp electrode parts were completed.

TABLE 7

| | Cylindrical sintered body (ingot) | | | |
|---|---|---|---|---|
| | Kind of cylindrical sintered body | Diameter mm × Length mm | Wire diameter of electrode part (mm) | Processing ratio (%) |
| Example 11 | Example 11 | Diameter 5 mm × 50 mm | Diameter 3 mm | 64 |
| Example 12 | Example 12 | Diameter 10 mm × 100 mm | Diameter 8 mm | 36 |
| Example 13 | Example 13 | Diameter 20 mm × 100 mm | Diameter 16 mm | 36 |
| Example 14 | Example 14 | Diameter 26 mm × 100 mm | Diameter 20 mm | 41 |
| Example 15 | Example 15 | Diameter 35 mm × 100 mm | Diameter 25 mm | 49 |
| Example 16 | Example 16 | Diameter 22.4 mm × 100 mm | Diameter 10 mm | 80 |
| Example 17 | Example 17 | Diameter 1.2 mm × 50 mm | Diameter 1 mm | 70 |
| Example 18 | Example 18 | Diameter 5 mm × 50 mm | Diameter 3 mm | 64 |
| Example 19 | Example 19 | Diameter 10 mm × 100 mm | Diameter 8 mm | 36 |
| Example 20 | Example 20 | Diameter 35 mm × 100 mm | Diameter 25 mm | 49 |

TABLE 7-continued

| | Cylindrical sintered body (ingot) | | | |
|---|---|---|---|---|
| | Kind of cylindrical sintered body | Diameter mm × Length mm | Wire diameter of electrode part (mm) | Processing ratio (%) |
| Comparative Example 11-1 | Comparative Example 11 | Diameter 10 mm × 50 mm | Diameter 3 mm | 91 |
| Comparative Example 11-2 | Comparative Example 11 | Diameter 9 mm × 100 mm | Diameter 8 mm | 21 |

Next, magnified photographs of the circumferential section (transverse section) and side section (vertical section) were taken of the body part of each of the discharge lamp electrode parts. The average particle diameter and maximum diameter of the HfC component, and the ratio, average particle diameter and aspect ratio of the tungsten crystal particles were then measured. For the magnified photographs, the circumferential section and side section passing through the center of the body part were cut out, and arbitrary unit areas of 300 μm×300 μm were investigated. The results are shown in Table 8.

TABLE 8

| | Tungsten crystal particle diameter | | | | | | HfC particles | | |
|---|---|---|---|---|---|---|---|---|---|
| | Circumferential section | | | Side section | | | | | |
| | Ratio of 1 to 80 μm (%) | Average particle diameter (μm) | Average aspect ratio | Ratio of 2 to 120 μm (%) | Average particle diameter (μm) | Average aspect ratio | Average particle diameter of primary particles (μm) | Maximum diameter of primary particles (μm) | Maximum diameter of secondary particles (μm) |
| Example 11 | 100 | 11.2 | 2.7 | 100 | 18.7 | 4.3 | 1.2 | 2.2 | 7.0 |
| Example 12 | 100 | 24.2 | 2.2 | 100 | 33.1 | 3.4 | 2.5 | 4.0 | 8.0 |
| Example 13 | 98 | 31.0 | 2.4 | 97 | 43.8 | 3.6 | 4.5 | 6.1 | 10.0 |
| Example 14 | 94 | 48.5 | 2.6 | 93 | 72.4 | 3.7 | 4.7 | 6.7 | 10.0 |
| Example 15 | 90 | 56.2 | 2.8 | 92 | 82.2 | 3.8 | 8.3 | 10.2 | 13.0 |
| Example 16 | 100 | 23.8 | 3.0 | 100 | 36.5 | 4.7 | 2.4 | 3.3 | 6.0 |
| Example 17 | 100 | 34.1 | 2.9 | 100 | 55.7 | 4.4 | 3.2 | 4.6 | 8.5 |
| Example 18 | 100 | 23.0 | 2.3 | 100 | 31.2 | 3.4 | 0.8 | 1.8 | 3.5 |
| Example 19 | 100 | 25.6 | 2.5 | 100 | 35.0 | 3.5 | 0.8 | 1.8 | 3.5 |
| Example 20 | 100 | 27.5 | 2.6 | 100 | 37.1 | 3.6 | 0.8 | 1.8 | 3.5 |
| Comparative Example 11-1 | 74 | 52.3 | 3.8 | 68 | 110.3 | 5.3 | 20 | 29.6 | 50 |
| Comparative Example 11-2 | 90 | 56.8 | 1.8 | 93 | 59.2 | 2.0 | 20 | 29.6 | 50 |

Next, the ratio of HfC in the Hf component was measured for each of the discharge lamp electrode parts. An oxygen content, a relative density (%), a Vickers hardness (Hv), and a three point bending strength were obtained.

The ratio of HfC in the Hf component was obtained by measuring the amount of Hf in the tungsten alloy according to an ICP analysis method and the amount of carbon in the tungsten alloy according to a combustion-infrared absorption method. Carbon in the tungsten alloy may be considered to be contained in HfC. Therefore, the detected total amount of Hf was defined as 100 parts by weight, and the amount of Hf contained in HfC was obtained. The mass ratio thereof was obtained. The oxygen content in the tungsten alloy was analyzed by an inert gas combustion-infrared absorption method. The relative density was obtained by dividing a measured density analyzed by an Archimedes method by a theoretical density. The theoretical density was obtained by the above calculation. The Vickers hardness (Hv) was obtained according to JIS-Z-2244. The three point bending strength was obtained according to JIS-R-1601. The results are shown in Table 9.

TABLE 9

| | x value when converted into $HfC_x$ | Parts by mass of Hf contained in HfC when the total amount of Hf is defined as 100 parts by mass | Oxygen content in tungsten alloy (wt %) | Relative density (%) | Vickers hardness (Hv) | Three point bending strength (MPa) |
|---|---|---|---|---|---|---|
| Example 11 | 0.70 | 70 | 0.1 | 99.2 | 490 | 505 |
| Example 12 | 0.50 | 50 | <0.01 | 96.3 | 420 | 437 |
| Example 13 | 0.40 | 40 | <0.01 | 96.5 | 428 | 452 |
| Example 14 | 0.75 | 75 | 0.4 | 98.0 | 480 | 478 |

TABLE 9-continued

| | x value when converted into $HfC_x$ | Parts by mass of Hf contained in HfC when the total amount of Hf is defined as 100 parts by mass | Oxygen content in tungsten alloy (wt %) | Relative density (%) | Vickers hardness (Hv) | Three point bending strength (MPa) |
|---|---|---|---|---|---|---|
| Example 15 | 0.35 | 35 | <0.01 | 99.3 | 492 | 498 |
| Example 16 | 0.60 | 60 | <0.01 | 99.8 | 502 | 517 |
| Example 17 | 0.55 | 55 | <0.01 | 99.4 | 495 | 508 |
| Example 18 | 0.67 | 67 | <0.01 | 99.3 | 505 | 517 |
| Example 19 | 0.48 | 48 | <0.01 | 97.7 | 442 | 451 |
| Example 20 | 0.63 | 63 | <0.01 | 99.5 | 485 | 487 |
| Comparative Example 11-1 | 0.48 | 48 | 0.2 | 99.0 | 820 | 382 |
| Comparative Example 11-2 | 0.48 | 48 | 0.2 | 92.2 | 280 | 321 |

The discharge lamp electrode parts according to the present Examples had high density, an excellent Vickers hardness (Hv), and excellent three point bending strength. This was because a part of HfC was decarbonized. The Hf component which was not carbonized into HfC was in any state of a state of metal Hf particles, a state where a part of surfaces of HfC particles were metal Hf, and a state of a solid solution of tungsten and hafnium. That is, two kinds (Hf and HfC) existed as the Hf component. Comparative Example 11-1 had large HfC particles becoming destructive starting points, which decreased the strength.

Examples 21 to 25

Next, the same tungsten powder and HfC powder as those in Example 12 were used, and a second component changed to a composition shown in Table 10 was prepared. These were subjected to furnace sintering at 2000° C. under a sintering condition of a hydrogen atmosphere, to obtain ingots. The ingots were processed at a processing ratio of 50%, to obtain electrode parts having a wire diameter of 10 mm. The electrode parts were subjected to a recrystallization heat treatment at 1600° C. under a hydrogen atmosphere. The same measurement was performed for each of Examples. The results were as shown in Tables 10 to 12.

TABLE 10

| | Amount of Hf component (in terms of HfC, wt %) | Addition component (material/wt %) |
|---|---|---|
| Example 21 | 1.0 | K/0.005 |
| Example 22 | 1.0 | Zr/0.01 |
| Example 23 | 1.0 | Zr/0.5 |
| Example 24 | 1.0 | ZrC/0.1 |
| Example 25 | 1.0 | Ta/0.2 |

TABLE 11

| | Tungsten crystal particle diameter | | | | | | HfC particles | | |
|---|---|---|---|---|---|---|---|---|---|
| | Circumferential section | | | Side section | | | | | |
| | Ratio of 1 to 80 μm (%) | Average particle diameter (μm) | Average aspect ratio | Ratio of 2 to 120 μm (%) | Average particle diameter (μm) | Average aspect ratio | Average particle diameter of primary particles (μm) | Maximum diameter of primary particles (μm) | Maximum diameter of secondary particles (μm) |
| Example 21 | 100 | 27.2 | 2.3 | 100 | 37.3 | 3.5 | 2.5 | 4.0 | 8.0 |
| Example 22 | 100 | 26.6 | 2.3 | 100 | 35.4 | 3.3 | 2.5 | 4.0 | 8.0 |
| Example 23 | 100 | 25.9 | 2.4 | 100 | 35.2 | 3.6 | 2.5 | 4.0 | 8.0 |
| Example 24 | 100 | 26.9 | 2.4 | 100 | 36.9 | 3.5 | 2.5 | 4.0 | 8.0 |
| Example 25 | 100 | 27.0 | 2.3 | 100 | 38.3 | 3.3 | 2.5 | 4.0 | 8.0 |

TABLE 12

| | x value when converted into $HfC_x$ | Parts by mass of Hf contained in HfC when the total amount of Hf is defined as 100 parts by mass | Oxygen content in tungsten alloy (wt %) | Relative density (%) | Vickers hardness (Hv) | Three point bending strength (MPa) |
|---|---|---|---|---|---|---|
| Example 21 | 0.55 | 55 | <0.01 | 98.1 | 440 | 456 |
| Example 22 | 0.53 | 53 | <0.01 | 98.6 | 437 | 450 |
| Example 23 | 0.52 | 52 | <0.01 | 98.5 | 438 | 453 |
| Example 24 | 0.56 | 56 | <0.01 | 98.8 | 446 | 453 |
| Example 25 | 0.46 | 46 | <0.01 | 98.4 | 442 | 457 |

As can be seen from the Tables, since the use of the addition elements strengthened a dispersion strengthening function and suppressed the grain growth of the tungsten crystals, enhancement of the strength was observed.

Examples 11A to 25A, Comparative Examples 11-1A to 11-2A, and Comparative Example 12A The emission characteristics of discharge lamp electrode parts of Examples 11 to 25, Comparative Example 11-1, and Comparative Example 11-2 were investigated. For the measurement of the emission characteristics, emission current densities ($mA/mm^2$) were measured by changing an applied voltage (V) to 100 V, 200 V, 300 V, and 400 V. The emission current densities were measured under conditions of an electric current load of 18±0.5 A/W applied to the discharge lamp electrode part and an application time of 20 ms.

A discharge lamp electrode part which was made of a tungsten alloy containing 2 wt % of $ThO_2$ and had a wire diameter of 8 mm was prepared as Comparative Example 12. The results are shown in Table 13.

TABLE 13

| | Electrode part | Emission current density ($mA/mm^2$) Applied Voltage 100 V | Applied Voltage 200 V | Applied Voltage 300 V | Applied Voltage 400 V |
|---|---|---|---|---|---|
| Example 11A | Example 11 | 1.9 | 34.1 | 46.2 | 47.5 |
| Example 12A | Example 12 | 2.2 | 35.2 | 47.9 | 48.1 |
| Example 13A | Example 13 | 2.7 | 36.2 | 48.4 | 50.4 |
| Example 14A | Example 14 | 2.8 | 38.3 | 48.9 | 51.1 |
| Example 15A | Example 15 | 3.3 | 39.5 | 50.2 | 53.5 |
| Example 16A | Example 16 | 2.9 | 38.7 | 50.4 | 53.7 |
| Example 17A | Example 17 | 2.5 | 36.1 | 48.4 | 49.6 |
| Example 18A | Example 18 | 2.0 | 34.7 | 47.4 | 47.8 |
| Example 19A | Example 19 | 1.7 | 32.9 | 43.1 | 45.3 |
| Example 20A | Example 20 | 4.5 | 45.8 | 53.2 | 57.0 |
| Example 21A | Example 21 | 2.4 | 36.5 | 48.4 | 49.2 |
| Example 22A | Example 22 | 2.4 | 36.7 | 48.5 | 49.5 |
| Example 23A | Example 23 | 2.4 | 36.7 | 48.5 | 49.4 |
| Example 24A | Example 24 | 2.6 | 37.2 | 49.3 | 50.2 |
| Example 25A | Example 25 | 2.3 | 36.2 | 48.2 | 49.4 |
| Comparative Example 11-1A | Comparative Example 11-1 | 2.7 | 35.3 | 47.1 | 50.0 |
| Comparative Example 11-2A | Comparative Example 11-2 | 2.2 | 30.5 | 45.3 | 46.4 |
| Comparative Example 12A | Comparative Example 12 | 1.1 | 31.1 | 43.0 | 45.0 |

The discharge lamp electrode parts according to Examples which contained no thorium oxide exhibited emission characteristics equal to or higher than those of Comparative Example 12 using thorium oxide. The temperatures of the cathode parts were 2100 to 2200° C. during measurement. For this reason, the discharge lamp electrode parts according to Examples have excellent strength at high temperature.

Examples 26 to 28

Next, there were prepared Example 26 (the recrystallization heat treatment condition of Example 11 was changed to 1800° C.), Example 27 (the recrystallization heat treatment condition of Example 13 was changed to 1800° C.), and Example 28 (the recrystallization heat treatment condition of Example 18 was changed to 1800° C.) produced by the same production method except that the recrystallization heat treatment condition was changed to 1800° C. in the discharge lamp electrodes of Example 11, Example 13, and Example 18. The same measurement was performed. The results are shown in Tables 14 and 15.

TABLE 14

| | Tungsten crystal particle diameter: Circumferential section: Ratio of 1 to 80 μm (%) | Circumferential section: Average particle diameter (μm) | Circumferential section: Average aspect ratio | Side section: Ratio of 2 to 120 μm (%) | Side section: Average particle diameter (μm) | Side section: Average aspect ratio | HfC particles: Average particle diameter of primary particles (μm) | Maximum diameter of primary particles (μm) | Maximum diameter of secondary particles (μm) |
|---|---|---|---|---|---|---|---|---|---|
| Example 26 | 100 | 14.1 | 3.1 | 100 | 25.2 | 4.8 | 1.2 | 2.2 | 7.0 |
| Example 27 | 98 | 33.8 | 2.7 | 95 | 46.3 | 4.0 | 4.5 | 6.1 | 10.0 |
| Example 28 | 100 | 27.6 | 2.6 | 100 | 36.3 | 3.8 | 0.8 | 1.8 | 3.5 |

TABLE 15

| | x value when converted into $HfC_x$ | Parts by mass of Hf contained in HfC when the total amount of Hf is defined as 100 parts by mass | Oxygen content in tungsten alloy (wt %) | Relative density (%) | Vickers hardness (Hv) | Three point bending strength (MPa) |
|---|---|---|---|---|---|---|
| Example 26 | 0.72 | 72 | 0.06 | 99.4 | 494 | 501 |
| Example 27 | 0.45 | 45 | <0.01 | 96.6 | 433 | 448 |
| Example 28 | 0.68 | 68 | <0.01 | 99.5 | 510 | 510 |

The discharge lamp electrode parts according to the present Examples had high density, an excellent Vickers hardness (Hv), and excellent three point bending strength. This was because a part of HfC was decarbonized. As a result of analyzing the Hf component which was not carbonized into HfC, the Hf component became a solid solution of tungsten and hafnium. That is, two kinds (Hf and HfC) existed as the Hf component. For this reason, when the recrystallization heat treatment temperature was set to 1700° C. or more, metal Hf was found to be likely to be solid-solved in tungsten. The emission characteristics were measured by the same method as that of Examples 11A. The results are shown in Table 16.

TABLE 16

| | Electrode part | Emission current density (mA/mm$^2$) | | | |
|---|---|---|---|---|---|
| | | Applied Voltage 100 V | Applied Voltage 200 V | Applied Voltage 300 V | Applied Voltage 400 V |
| Example 26A | Example 26 | 2.0 | 34.5 | 47.7 | 48.8 |
| Example 27A | Example 27 | 2.9 | 36.8 | 50.1 | 52.6 |
| Example 28A | Example 28 | 2.2 | 35.2 | 48.4 | 49.8 |

It was found that all of metal Hf is solid-solved in tungsten as described above, which improves the emission characteristics. This is considered to be because the existence of metal Hf on the surface of the tungsten alloy is likely to be caused by the solid solution.

Since the embodiments has excellent emission characteristics as described above, the embodiments can be used for not only the discharge lamp electrode part but also fields such as the magnetron part (coil part) and the transmitting tube part (mesh grid) requiring the emission characteristics.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A method for producing a tungsten alloy for a discharge lamp, a transmitting tube or a magnetron, the method comprising:

mixing a HfC powder comprising primary particles having an average particle diameter of 15 μm or less and a tungsten powder having an average particle diameter of 0.5 to 10 μm to obtain a raw powder;

molding the raw powder to obtain a molded body;

sintering the molded body to obtain a sintered body; and performing at least one process selected from the group consisting of forging, rolling, wiredrawing, cutting, and polishing, after the sintering step;

wherein a processing ratio [(A−B)/A]×100 of the at least one process is within a range of 30 to 90%, wherein A is a sectional area of the sintered body before the at least one process and B is a sectional area of the sintered body after the at least one process.

2. The method according to claim 1, wherein a content of the HfC powder in the raw powder is 0.1 to 3 wt %.

3. The method according to claim 1, wherein the raw powder comprises 0.01 wt % or less of a dope material which is at least one element selected from the group consisting of K, Si, and Al.

4. The method according to claim 1, wherein an average particle diameter of the HfC powder is equal to or smaller than the average particle diameter of the tungsten powder.

5. The method according to claim 1, wherein the sintering is performed at a temperature of 1400 to 3000° C. for 1 to 20 hours.

6. The method according to claim 1, wherein the sintering comprises presintering of the molded body at a temperature of 1250 to 1500° C. to obtain a presintered body and electric sintering of the presintered body at a temperature of 2100 to 2500° C.

7. The method according to claim 1, further comprising performing a stress relief heat treatment at a temperature of 1300 to 2500° C. after the at least one process.

8. The method according to claim 1, wherein the average particle diameter of the HfC powder is less than the average particle diameter of the tungsten powder.

* * * * *